US005281502A

United States Patent [19]

Brewington et al.

[11] Patent Number: 5,281,502

[45] Date of Patent: Jan. 25, 1994

[54] TRI-LEVEL IMAGING PROCESSES WITH ADJUSTABLE COLOR

[75] Inventors: Grace T. Brewington, Fairport; Richard W. Bigelow, Webster; Robert W. Anderson, Fairport; Paul C. Julien; Susan J. Kremer, both of Webster, all of N.Y.

[73] Assignee: Xerox Corporation, Stamford, Conn.

[21] Appl. No.: 895,079

[22] Filed: Jun. 8, 1992

[51] Int. Cl.[5] ..... G03G 13/01

[52] U.S. Cl. ..... 430/45; 430/126

[58] Field of Search ..... 430/45, 42, 31, 126

[56] References Cited

U.S. PATENT DOCUMENTS

| | | | |
|---|---|---|---|
| 3,013,890 | 12/1961 | Bixby | 117/17.5 |
| 3,045,644 | 9/1962 | Schwertz | 118/637 |
| 4,078,929 | 4/1978 | Gundlach | 96/1.2 |
| 4,264,185 | 4/1981 | Ohta | 355/4 |
| 4,308,821 | 1/1982 | Matsumoto | 118/645 |
| 4,312,932 | 1/1982 | Hauser et al. | 430/45 |
| 4,378,415 | 3/1983 | Chu | 430/45 |
| 4,395,471 | 7/1983 | Hauser et al. | 430/45 |
| 4,430,402 | 2/1984 | Tsushima | 430/45 |
| 4,500,616 | 2/1985 | Haneda et al. | 430/45 |
| 4,524,117 | 6/1985 | Maekawa et al. | 430/44 |
| 4,525,447 | 6/1985 | Tanaka et al. | 430/122 |
| 4,539,281 | 11/1983 | Tanaka et al. | 430/45 |
| 4,562,129 | 11/1985 | Tanaka et al. | 430/42 |
| 4,594,302 | 6/1986 | Kubo | 430/42 |
| 4,640,883 | 2/1987 | Oka | 430/122 |
| 4,686,163 | 8/1987 | Ng et al. | 430/47 |
| 4,948,686 | 8/1990 | Koch et al. | 430/45 |
| 5,176,974 | 1/1993 | Till et al. | 430/53 |

*Primary Examiner*—John Goodrow
*Attorney, Agent, or Firm*—Judith L. Byorick

[57] ABSTRACT

Disclosed is a process for forming two-color images which comprises (1) charging an imaging member in an imaging apparatus; (2) creating on the member a latent image comprising areas of high, intermediate, and low potential; (3) developing the low areas of potential with a colored developer comprising a colored first toner comprising a polymer resin selected from the group consisting of styrene-butadiene copolymers, styrene-acrylate copolymers, styrene-methacrylate copolymers, and mixtures thereof, a blue first colored pigment of the formula $C_{32}H_{16}N_8Cu$, a cetyl pyridinium chloride charge control agent, a 3,5-di-tertbutyl salicylate compound charge control agent, colloidal silica surface external additives, and metal stearate salt surface external additives; a colored second toner comprising a polymer resin selected from the group consisting of styrene-butadiene copolymers, styrene-acrylate copolymers, styrene-methacrylate copolymers, and mixtures thereof, a cyan second colored pigment of the formula $C_{104}H_{164}N_{12}O_8S_4Cu$, a charge control agent selected from the group consisting of distearyl dimethyl ammonium methyl sulfate and distearyl dimethyl ammonium bisulfate, colloidal silica surface external additives, and metal stearate salt surface external additives; and a color carrier comprising a core and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles; (4) subsequently developing the high areas of potential with a black developer comprising a black toner comprising a second resin present selected from the group consisting of polyesters, styrene-butadiene polymers, styrene-acrylate polymers, styrene-methacrylate polymers, and mixtures thereof, a black pigment, and a charge control additive; and a black carrier comprising a core and a coating selected from the group consisting of chlorotrifluoroethylene-vinyl chloride copolymer containing from 0 to about 40 percent by weight of conductive particles; polyvinylfluoride; and polyvinylchloride; and (5) transferring the developed two-color image to a substrate.

21 Claims, No Drawings

TRI-LEVEL IMAGING PROCESSES WITH ADJUSTABLE COLOR

BACKGROUND OF THE INVENTION

The present invention is directed to a process for forming two-color images. More specifically, the present invention is directed to a process for forming two-color images which comprises charging an imaging member, creating on the member a latent image comprising areas of high, medium, and low potential, developing the low areas of potential with a colored developer comprising a first blue colored toner, a second cyan colored toner, and a specific "color" carrier as described herein, subsequently developing the high areas of potential with a black developer comprising a specific black toner and a specific "black" carrier as described herein, transferring the developed two-color image to a substrate, and optionally permanently affixing the image to the substrate.

The process of charging a photoresponsive imaging member to a single polarity and creating on it an image consisting of at least three different levels of potential of the same polarity is disclosed in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area, with the second and third areas functioning as image areas. The charge pattern is developed in a first step with positively charged toner particles of a first color, and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the tri-level process for generating images is U.S. Pat. No. 4,686,163.

U.S. Pat. No. 4,948,686, the disclosure of which is totally incorporated herein by reference, discloses a process for forming two-color images which comprises (1) charging an imaging member in an imaging apparatus; (2) creating on the member a latent image comprising areas of high, intermediate, and low potential; (3) developing the low areas of potential with a developer comprising a colored first toner comprising a first resin selected from the group consisting of polyesters, styrene-butadiene polymers, styrene-acrylate polymers, styrene-methacrylate polymers, and mixtures thereof; a first pigment; a charge control agent; colloidal silica surface external additives present; and external additives comprising metal salts or metal salts of fatty acids; and a first carrier comprising a core and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles; (4) subsequently developing the high areas of potential with a developer comprising a black second toner comprising a second resin present selected from the group consisting of polyesters, styrene-butadiene polymers, styrene-acrylate polymers, styrene-methacrylate polymers, and mixtures thereof; a second pigment; and a second charge control additive; and a second carrier comprising a core and a coating selected from the group consisting of chlorotrifluoroethylene-vinyl chloride copolymer containing from 0 to about 40 percent by weight of conductive particles; polyvinylfluoride; and polyvinylchloride; and (5) transferring the developed two-color image to a substrate.

U.S. Pat. No. 4,264,185, the disclosure of which is totally incorporated herein by reference, discloses an apparatus for forming two color images by forming a bipolar electrostatic image of a two color original document on a photoconductive drum. A first developing unit applies a toner of a first color and polarity to the drum and a second developing unit applies a toner of a second color and polarity to the drum to form a two color electrostatic image which is transferred and fixed to a copy sheet. A bias voltage of the first polarity is applied to the second developing unit to repel the toner of the first color and polarity against the drum and prevent degradation of the first color toner image. A bias voltage of the second polarity is applied to the first developing unit to prevent contamination of the first color toner with the second color toner.

U.S. Pat. No. 4,308,821 discloses a method and apparatus for forming two-color images which employs two magnetic brushes. The first developed image is not disturbed during development of the second image, since the second magnetic brush contacts the surface of the imaging member more lightly than the first magnetic brush, and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the imaging member. In addition, the toners may have different quantities of electric charge.

U.S. Pat. No. 4,378,415 discloses a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components, and carrier particles.

U.S. Pat. No. 4,430,402, discloses a two-component type dry developer for use in dichromatic electrophotography which comprises two kinds of developers, each of which consists of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

U.S. Pat. No. 4,500,616 discloses a method of developing electrostatic latent images by selectively extracting colored grains of one polarity from a mixture containing colored grains having opposite polarity to each other in the presence of an alternating field, followed by development of the electrostatic image by the selectively extracted colored grains.

U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image, to develop the non-charged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

U.S. Pat. No. 4,525,447, the disclosure of which is totally incorporated herein by reference, discloses an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier.

U.S. Pat. No. 4,539,281 discloses a method of forming dichromatic copy images by forming an electrostatic latent image having a first image portion and a second image portion. The first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a non-magnetic toner of a second color chargeable to a polarity opposite to that of the magnetic toner by contact with the magnetic carrier.

U.S. Pat. No. 4,562,129, the disclosure of which is totally incorporated herein by reference, discloses a method of forming dichromatic copy images with a developer composed of a high-resistivity magnetic carrier and a nonmagnetic insulating toner which are triboelectrically chargeable. An electrostatic latent image having at least three different levels of potential is formed and the toner and carrier are adhered respectively onto the first and second image portions.

U.S. Pat. No. 4,640,883, the disclosure of which is totally incorporated herein by reference, discloses a method of forming composite or dichromatic images which comprises forming on an imaging member electrostatic latent images having at least three different potential levels, the first and second latent images being represented respectively by a first potential and a second potential relative to a common background potential. The first and second images are developed by a first magnetic brush using two kinds of toners, at least one of which is magnetic, and both of which are chargeable to polarities opposite to each other, with application to a developing electrode of a bias voltage capable of depositing the magnetic toner on the background potential area, to deposit selectively the two toners on the first and second latent images and to deposit the magnetic toner on the background potential area, while collecting the deposited magnetic toner at least from the background potential area by second magnetic brush developing means.

U.S. Pat. No. 3,013,890 (Bixby), the disclosure of which is totally incorporated herein by reference, discloses a method and composition for making visible electrostatic images whereby both positive and negative electrostatic images may be developed simultaneously in one or two colors. The process entails generating an electrostatic image on an insulating surface, bringing to the insulating surface a solid surface having electrostatically coated thereon positively and negatively charged powder particles, whereby the particles are electrostatically attracted from the surface bearing the powder particles to deposit on the insulating surface in conformity with electrostatic lines of force of the electrostatic image. In a specific embodiment, both kinds of toner particles are both coated onto a single carrier and, relative to the carrier surface, the first toner particles assume a positive electrostatic charge and the second toner particles assume a negative electrostatic charge.

U.S. Pat. No. 3,045,644 (Schwertz), the disclosure of which is totally incorporated herein by reference, discloses a two-color electrostatic apparatus for recording and printing information. An electrostatic latent image is applied to an insulating surface, said image having areas of both positive polarity and negative polarity. Subsequently, positively charged and negatively charged toner particles of two different colors are applied consecutively to the latent image to develop the two-color image.

U.S. Pat. No. 4,395,471 (Hauser et al.), the disclosure of which is totally incorporated herein by reference, discloses a developer composition comprising a styrene/n-butyl methacrylate copolymer resin, a colorant, and a single carrier. In one embodiment, the composition is a combination of a single carrier, a cyan toner comprising a styrene/n-butyl methacrylate copolymer resin and a tetra-4-(octadecylsulfonomido)phthalocyanine pigment, a magenta toner comprising a styrene/n-butyl methacrylate copolymer resin and a 2,9-dimethyl substituted quinacridone pigment, and/or a yellow toner comprising a styrene/n-butyl methacrylate copolymer resin and a diaryldide 3,3-dichlorobenzidene aceto acetanilide pigment. A series of toners is provided wherein a variety of single colored toners are obtained by blending different amounts of the primary colors together with the carrier.

U.S. Pat. No. 4,312,932 (Hauser et al.), the disclosure of which is totally incorporated herein by reference, discloses a color developing composition comprising a single carrier and toner resin particles, each toner particle containing up to four pigments. A series of toners is provided wherein a variety of single colored toners are obtained by incorporating different amounts of the pigments into each toner in the series.

Also directed to the tri-level imaging process and specific embodiments thereof are U.S. Pat. No. 4,903,048, U.S. Pat. No. 4,847,655, U.S. Pat. No. 4,811,046, U.S. Pat. No. 5,021,838, U.S. Pat. No. 4,833,504, U.S. Pat. No. 5,079,114, U.S. Pat. No. 5,080,988, and U.S. Pat. No. 4,901,114, the disclosures of each of which are totally incorporated herein by reference.

Copending Application U.S. Ser. No. 07/755,979, entitled "Improved Toner and Process for Forming Two-Color Images," with the named inventors Edward J. Gutman, Michael L. Grande, William H. Hollenbaugh, Jr., and Roger N. Ciccarelli, filed Sep. 6, 1991, the disclosure of which is totally incorporated herein by reference, discloses a toner composition comprising a resin, a colorant, and a charge control additive selected from the group consisting of (a) zinc 3,5-di-tert-butyl salicylate compounds; (b) mixtures of a zinc 3,5-di-tert-butyl salicylate compound and an alkyl pyridinium halide; (c) mixtures of a zinc 3,5-di-tert-butyl salicylate compound and distearyl dimethyl ammonium methyl sulfate; (d) mixtures of a zinc 3,5-di-tert-butyl salicylate compound and distearyl dimethyl ammonium bisulfate; (e) mixtures of an aluminum 3,5-di-tert-butyl salicylate compound and an alkyl pyridinium halide; (f) mixtures of an aluminum 3,5-di-tert-butyl salicylate compound and distearyl dimethyl ammonium methyl sulfate; (g) mixtures of an aluminum 3,5-di-tert-butyl salicylate compound and distearyl dimethyl ammonium bisulfate; and mixtures thereof, a colloidal silica external additive, and a metal salt of a fatty acid external additive. Also disclosed are imaging processes employing the toner, including a process for forming two-color images which comprises creating on an imaging member a latent image comprising areas of high, medium, and low potential, developing the low areas of potential with a developer comprising the toner disclosed herein and a carrier, subsequently developing the high areas of potential with a developer comprising a toner of a second color and a carrier, transferring the developed two-color image to a substrate, and optionally permanently affixing the image to the substrate.

Copending Application U.S. Ser. No. 07/755,915, entitled "Improved Electrostatic Developing Composition and Process", with the named inventors Don B. Jugle, Michael L. Grande, Edward J. Gutman, Douglas A. Lundy, and Charles D. Zimmer, filed Sep. 6, 1991, the disclosure of which is totally incorporated herein by reference, discloses a developer composition which consists essentially of a toner consisting essentially of a resin, a colorant, and colloidal silica external additive particles and a carrier consisting essentially of a core, an optional coating on the core, and an external additive selected from the group consisting of metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof. Also disclosed are processes for using the aforementioned developer in a tri-level development process.

Copending Application U.S. Ser. No. 07/706,476, entitled "Passivated Toner Compositions," with the named inventors Roger N. Ciccarelli and Denise R. Bayley, filed May 28, 1991, the disclosure of which is totally incorporated herein by reference, discloses a process for the preparation of passivated toners with a substantially stable positive or negative triboelectic value of from about 10 to about 30 microcoulombs per gram which comprises admixing toner resin particles, colored pigment particles, and a charge enhancing additive and subsequently adding thereto surface additives, wherein the charge additive functions primarily as a passivating component. The toners are useful in tri-level processes for creating two-color images in a single pass. Also disclosed is the admixing in known effective amounts of known cyan, magenta, and yellow toners, preferably with a common carrier, to obtain process colors like red, blue, green, and the like.

Copending Application U.S. Ser. No. 07/706,477, entitled "Passivated Green Toner Compositions," with the named inventors Roger N. Ciccarelli and Denise R. Bayley, filed May 28, 1991, the disclosure of which is totally incorporated herein by reference, discloses a green toner comprising resin particles, HELIOGEN GREEN TM pigment particles, a charge enhancing additive, and surface additive particles. The toner is useful in tri-level processes for creating two-color images in a single pass. Also disclosed is the admixing in known effective amounts of known cyan, magenta, and yellow toners, preferably with a common carrier, to obtain process colors like red, blue, green, and the like.

Copending Application U.S. Ser. No. 07/705,595, entitled "Magenta Toner Compositions," with the named inventors Roger N. Ciccarelli and Don B. Jugle, filed May 28, 1991, the disclosure of which is totally incorporated herein by reference, discloses a toner comprising resin particles, magenta pigment particles, and surface additive particles comprising a mixture of colloidal silica, metal oxide, and a polymeric hydroxy compound. The toner is useful in tri-level processes for creating two-color images in a single pass.

While known compositions and processes for forming two-color images are suitable for their intended purposes, a need remains for processes for forming two-color images by a tri-level process wherein at least one of the colors can be adjusted for custom applications. Adjusting the color of a toner employed in a tri-level imaging process is generally a complex process that entails more than merely adjusting the concentrations of one or more pigments contained in the toner. For example, some pigments can be compatible with the toner resin for the present purposes only over a limited concentration range. In addition, pigments may have inherent charging characteristics that will result in admix problems when the pigment concentration is changed. Further, if a blend of two or more colors is employed to develop one of the images in a two-color tri-level imaging process, both toners in the blend must become charged uniformly and rapidly to the same polarity and approximately the same charge magnitude so that both toners transfer from the developer housing to the latent image in the desired concentrations during image development. Additionally, the toner or toners employed to develop one image in a two-color tri-level imaging process must not interact with the toner or carrier employed to develop the image of the other color. Thus, a need remains for processes for forming two-color images wherein one of the colors is developed with a mixture of two types of toner particles of different colors which, when blended, form a desired custom color. Further, there is a need for processes for for forming two-color images wherein one of the colors is developed with a mixture of two types of toner particles of different colors which can be blended in varying ratios to obtain a wide range of blends of desired colors. Additionally, there is a need for processes for forming two-color images wherein one of the colors is developed with a mixture of two types of toner particles of different colors which can be blended in varying ratios such that both types of toner particles become charged to the same polarity and obtain similar charge magnitudes. There is also a need for processes for forming two-color images wherein one of the colors is developed with a mixture of two types of toner particles of different colors and wherein the admix times for each type of toner particle are acceptable. Further, there is a need for processes for forming two-color images wherein one of the colors is developed with a mixture of two types of toner particles of different colors and wherein neither toner in the mixture employed to develop one color interacts with the toner or carrier employed to develop the other color. Mutual and deleterious interaction may occur, for example, when the carrier of the developer used second triboelectrically charges against the toner used first; thus, the first image is developed with the first developer and the second image is subsequently developed with the second developer of different color, and during development of the second image, the carrier of the second developer triboelectrically interacts with the image previously developed with the first toner. This interaction can result in removal of some of the first toner from the substrate, causing reduced image density, and can also lead to contamination of the second developer housing with the first toner. A need also exists for a process for forming two-color images wherein the second developer does not react with, or is triboactively neutral to, the first developed image on the photoreceptor. A need also exists for a process for forming two-color images wherein the first developer comprises a mixture of two types of toner particles of different colors and the mixture does not discharge the latent image to be developed by the second developer. Additionally, there is a need for a two-color image formation process wherein the developers are of specified triboelectric charge, charge distribution, and conductivity, and exhibit acceptable admix times and developer lifetimes. Further, there is a need for a two-color image formation process wherein the developers exhibit similar rheological properties, thereby enhancing fusing, and similar cleaning latitudes, thereby enhancing cleaning of the photoreceptor.

SUMMARY OF THE INVENTION

It is an object of the present invention to provide processes for forming two-color images by a tri-level process which exhibit the above-noted advantages.

It is another object of the present invention to provide processes for forming two-color images by a tri-level process wherein at least one of the colors can be adjusted for custom applications.

It is another object of the present invention to provide processes for forming two-color images wherein one of the colors is developed with a mixture of two types of toner particles of different colors which, when blended, form a desired custom color.

It is yet another object of the present invention to provide processes for forming two-color images wherein one of the colors is developed with a mixture of two types of toner particles of different colors which can be blended in varying ratios to obtain a wide range of blends of desired colors.

It is still another object of the present invention to provide processes for forming two-color images wherein one of the colors is developed with a mixture of two types of toner particles of different colors which can be blended in varying ratios such that both types of toner particles become charged to the same polarity and obtain similar charge magnitudes.

Another object of the present invention is to provide processes for forming two-color images wherein one of the colors is developed with a mixture of two types of toner particles of different colors and wherein the admix times for each type of toner particle are acceptable.

Yet another object of the present invention is to provide processes for forming two-color images wherein one of the colors is developed with a mixture of two types of toner particles of different colors and wherein neither toner in the mixture employed to develop one color interacts with the toner or carrier employed to develop the other color.

Still another object of the present invention is to provide a process for forming two-color images wherein the second developer does not react with, or is triboactively neutral to, the first developed image on the photoreceptor.

It is another object of the present invention to provide a process for forming two-color images wherein the first developer comprises a mixture of two types of toner particles of different colors and the mixture does not discharge the latent image to be developed by the second developer.

It is yet another object of the present invention to provide a two-color image formation process wherein the developers are of specified triboelectric charge, charge distribution, and conductivity, and exhibit acceptable admix times and developer lifetimes.

It is still another object of the present invention to provide a two-color image formation process wherein the developers exhibit similar rheological properties, thereby enhancing fusing, and similar cleaning latitudes, thereby enhancing cleaning of the photoreceptor.

These and other objects of the present invention (or specific embodiments thereof) can be achieved by providing a process for forming two-color images which comprises (1) charging an imaging member in an imaging apparatus; (2) creating on the member a latent image comprising areas of high, intermediate, and low potential; (3) developing the low areas of potential with a colored developer comprising a colored first toner comprising a polymer resin selected from the group consisting of styrene-butadiene copolymers, styrene-acrylate copolymers, styrene-methacrylate copolymers, and mixtures thereof, a blue first colored pigment of the formula $C_{32}H_{16}N_8Cu$, a cetyl pyridinium chloride charge control agent, a 3,5-di-tert-butyl salicylate compound charge control agent, colloidal silica surface external additives, and metal stearate salt surface external additives; a colored second toner comprising a polymer resin selected from the group consisting of styrene-butadiene copolymers, styrene-acrylate copolymers, styrene-methacrylate copolymers, and mixtures thereof, a cyan second colored pigment of the formula $C_{104}H_{164}N_{12}O_8S_4Cu$, a charge control agent selected from the group consisting of distearyl dimethyl ammonium methyl sulfate and distearyl dimethyl ammonium bisulfate, colloidal silica surface external additives, and metal stearate salt surface external additives; and a color carrier comprising a core and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles; (4) subsequently developing the high areas of potential with a black developer comprising a black toner comprising a second resin present selected from the group consisting of polyesters, styrene-butadiene polymers, styrene-acrylate polymers, styrene-methacrylate polymers, and mixtures thereof, a black pigment, and a charge control additive; and a black carrier comprising a core and a coating selected from the group consisting of chlorotrifluoroethylene-vinyl chloride copolymer containing from 0 to about 40 percent by weight of conductive particles; polyvinylfluoride; and polyvinylchloride; and (5) transferring the developed two-color image to a substrate.

Imaging members suitable for use with the process of the present invention may be of any type capable of maintaining three distinct levels of potential. Generally, various dielectric or photoconductive insulating material suitable for use in xerographic, ionographic, or other electrophotographic processes may be used, and suitable photoreceptor materials include amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can consist of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range, with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging members selected.

The latent image comprising three levels of potential, hereinafter referred to as a tri-level image, may be formed on the imaging member by any of various suitable methods, such as those disclosed in U.S. Pat. No. 4,078,929, the disclosure of which is totally incorporated herein by reference. For example, a tri-level charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a tri-level charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power. Other electrophotographic and ionographic methods of generating latent images are also acceptable.

Generally, in the process of the present invention the highlighted areas of the image are developed with a developer having a color other than black, while the remaining portions of the image are developed with a black developer. In general, the highlighted color portions are developed first to minimize the interaction between the two developers, thereby maintaining the high quality of the black image.

Development is generally by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred, wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is laid on the photoreceptor under these development potentials to result in acceptable image density. Conductive development is also preferred to ensure that fringe fields occurring around the edges of images of one color are not developed by the toner of the other color.

During the development process, the developer housings are biased to a voltage between the level of potential being developed and the intermediate level of charge on the imaging member. For example, if the latent image consists of a high level of potential of about −800 volts, an intermediate level of potential of about −400 volts, and a low level of about −100 volts, the developer housing containing the positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges provided that the objectives of the present invention are achieved.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

Colored developers suitable for the process of the present invention comprise a toner and a carrier. Preferred carriers for the colored developer (hereinafter referred to as "color carriers") are generally conductive, and generally exhibit a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating; by partially coating the carrier core, or by coating the core with a coating of a material containing carbon black, the carrier is rendered conductive. In addition, irregularly shaped carrier particle surfaces and toner concentrations of from about 0.2 to about 5 will generally render a developer conductive. Addition of a surface additive such as zinc stearate to the surface of the toner particles also renders a developer conductive, with the level of conductivity rising with increased concentrations of the additive. The carrier for the colored developers of the present invention generally comprises a steel core, preferably unoxidized, such as Hoeganoes Anchor Steel Grit, typically with an average diameter of from about 25 to about 215 microns, preferably from 50 to 150 microns. The carrier particles are coated with a solution coating of methyl terpolymer containing from 0 to about 40 percent by weight of conductive particles such as carbon black or other conductive particles as disclosed in U.S. Pat. No. 3,533,835, the disclosure of which is totally incorporated herein by reference, homogeneously dispersed in the coating material, with the coating weight typically being from about 0.2 to about 3 percent by weight of the carrier, and preferably from about 0.4 to about 1.5 percent by weight of the carrier. Alternatively, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight typically is from about 0.2 to about 3 percent by weight of the carrier and preferably about 1 percent by weight of the carrier. A third possible carrier coating for the carrier of the colored developer comprises a blend of from about 35 to about 65 percent by weight of polymethylmethacrylate and from about 35 to about 65 percent by weight of chlorotrifluoroethylene-vinyl chloride copolymer, commercially available as OXY 461 from Occidental Petroleum Company containing conductive particles in an amount of from 0 to about 40 percent by weight, and preferably from about 20 to about 30 percent by weight, wherein the coating weight typically is from about 0.2 to about 3 percent by weight of the carrier, and preferably about 1 percent by weight of the carrier. Preferably, the carrier coatings are placed on the carrier cores by a solution coating process.

The colored developer employed to develop the color images contains a blend of two different types of toner particles. The first colored toner contains a polymer resin selected from the group consisting of styrene-butadiene copolymers, styrene-acrylate copolymers, and styrene-methacrylate copolymers. Suitable styrene-butadiene copolymers include (but are not limited to) those wherein the styrene portion is present in an amount of from about 83 to about 93 percent by weight, preferably about 88 percent by weight, and the butadiene portion is present in an amount of from about 7 to about 17 percent by weight, preferably about 12 percent by weight, such as the resins commercially available as Pliolite ® or Pliotone ® from Goodyear, Akron, Ohio. Also suitable are styrene acrylate polymers and styrene-n-butylmethacrylate polymers, particularly those styrene-n-butylmethacrylate copolymers wherein the styrene portion is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Also particularly suitable for inclusion in the toners for the present invention are styrene-n-butylmethacrylate polymers wherein the styrene portion is present in an amount of from about 50 to about 80 percent by weight, and the n-butylmethacrylate portion is present in an amount of from about 50 to about 20 percent by weight, preferably about 35 percent by weight. The resin typically is present in the first colored toner in an amount of from about 85 to about 98 percent by weight, and preferably from about 90 to about 95 percent by weight, although the amount can be outside these ranges.

The first colored toner also comprises a colored blue pigment. This pigment is known as Pigment Blue 15, with the chemical formula $C_{32}H_{16}N_8Cu$ (CAS #00147-14-8) (copper, [29H, 31H-phthalocyaninato(2-

)N29, N30, N31, N32]-, (SP-4-1)-(9Cl)) and believed to have the structural formula

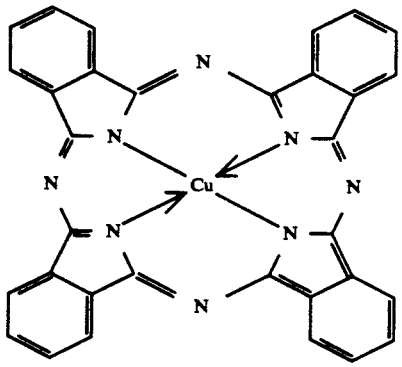

Pigments of this type are commercially available as PV Fast Blue from Hoechst-Celanese, Somerville, N.J. The blue colored pigment typically is present in the first colored toner in an amount of from about 1 to about 10 percent by weight, and preferably from about 4 to about 8 percent by weight, although the amount can be outside these ranges.

The first colored toner also contains two charge control agents. The first charge control agent is cetyl pyridinium chloride, as disclosed in U.S. Pat. No. 4,298,672, the disclosure of which is totally incorporated herein by reference, commercially available from Hexcel Corporation, Lodi, N.J. The cetyl pyridinium chloride charge control agent typically is present in the first colored toner in an amount of from about 0.1 to about 1.0 percent by weight, and preferably from about 0.3 to about 0.6 percent by weight, although the amount can be outside these ranges.

The second charge control agent in the first colored toner is a 3,5-di-tert-butyl salicylate compound. This charge control agent can be an aluminum 3,5-di-tert-butyl salicylate compound, such as Bontron E-88, available from Orient Chemical Company of Japan, or aluminum compounds as disclosed in U.S. Pat. No. 4,845,003, the disclosure of which is totally incorporated herein by reference. The aluminum compound charge control additives are compounds of aluminum with 3,5-di-tertiary-butyl salicylic acid, and according to U.S. Pat. No. 4,845,003 are prepared from an aromatic hydroxycarboxylic acid with an alkyl and/or aralkyl by treating the acid with an aluminum imparting agent by a known method. The second charge control agent in the first colored toner can also be a zinc 3,5-di-tert-butyl salicylate compound, such as Bontron E-84, available from Orient Chemical Company of Japan, or zinc compounds as disclosed in U.S. Pat. No. 4,656,112, the disclosure of which is totally incorporated herein by reference. Further, the second charge control agent in the first colored toner can be a boron 3,5-di-tert-butyl salicylate compound, such as LR120, available from Orient Chemical Company of Japan. The 3,5-di-tert-butyl salicylate compound charge control agent typically is present in the first colored toner in an amount of from about 0.1 to about 5 percent by weight, and preferably from about 0.5 to about 3 percent by weight, although the amount can be outside these ranges.

The first colored toner also has contained on the surface of the toner particles external additives of colloidal silica, such as Aerosil ® R972, Aerosil ® R976, Aerosil ® R812, and the like, available from Degussa, and metal salts or metal salts of stearates, such as zinc stearate, magnesium stearate, aluminum stearate, cadmium stearate, and the like, are blended on the surface of the toners of the present invention. In general, toners with these additives blended on the surface are disclosed in U.S. Pat. No. 3,590,000, U.S. Pat. No. 3,720,617, U.S. Pat. No. 3,900,588, and U.S. Pat. No. 3,983,045, the disclosures of each of which are totally incorporated herein by reference. Typically, the silica is present on the surface in an amount of from about 0.1 to about 2 percent by weight of the toner particle, and preferably about 0.3 percent by weight of the toner particle, and the metal stearate salt additive such as zinc stearate typically is present on the surface in an amount of from about 0.1 to about 2 percent by weight of the toner particle, preferably from about 0.1 to about 0.5 percent by weight of the toner particle, and more preferably about 0.3 percent by weight of the toner particle, although the amounts can be outside these ranges.

The second colored toner contains a polymer resin selected from the group consisting of styrene-butadiene copolymers, styrene-acrylate copolymers, and styrene-methacrylate copolymers. Suitable styrene-butadiene copolymers include (but are not limited to) those wherein the styrene portion is present in an amount of from about 83 to about 93 percent by weight, preferably about 88 percent by weight, and the butadiene portion is present in an amount of from about 7 to about 17 percent by weight, preferably about 12 percent by weight, such as the resins commercially available as Pliolite ® or Pliotone ® from Goodyear, Akron, Ohio. Also suitable are styrene acrylate polymers and styrene-n-butylmethacrylate polymers, particularly those styrene-n-butylmethacrylate copolymers wherein the styrene portion is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Also particularly suitable for inclusion in the toners for the present invention are styrene-n-butylmethacrylate polymers wherein the styrene portion is present in an amount of from about 50 to about 80 percent by weight, and the n-butylmethacrylate portion is present in an amount of from about 50 to about 20 percent by weight, preferably about 35 percent by weight. The resin typically is present in the second colored toner in an amount of from about 85 to about 98 percent by weight, and preferably from about 90 to about 95 percent by weight, although the amount can be outside these ranges.

The second colored toner also comprises a colored cyan pigment. This pigment is of the chemical formula $C_{104}H_{164}N_{12}O_8S_4Cu$ (CAS #39702-40-4) (copper, [N, N', N'', N'''-tetraoctadecyl-29H, 31H-phthalocyanine-C,C,C,C-tetrasulfonamidato(2-)-N29,N30,N31,N32]-(9Cl)) and is believed to be of the structural formula

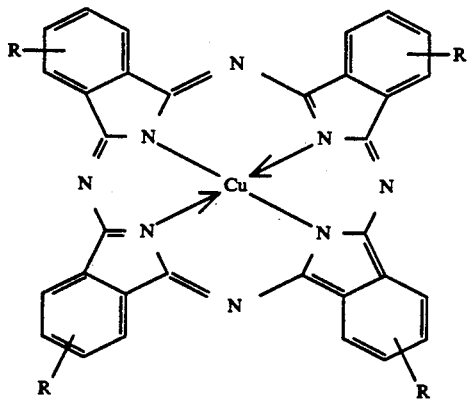

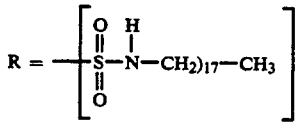

Pigments of this type are commercially available as Neopen Blue from BASF, Parsippany, N.J. The cyan colored pigment typically is present in the second colored toner in an amount of from about 1 to about 10 percent by weight, preferably from about 4 to about 8 percent by weight, and more preferably from about 3 to about 6 percent by weight, although the amount can be outside these ranges.

The second colored toner also contains a charge control agent. This charge control agent can be a distearyl dimethyl ammonium methyl sulfate as disclosed in U.S. Pat. No. 4,560,635, the disclosure of which is totally incorporated herein by reference, commercially available from Hexcel Corporation, Lodi, N.J. In addition, the charge control agent in the second colored toner can be a distearyl dimethyl ammonium bisulfate, as disclosed in U.S. Pat. No. 4,904,762, U.S. Pat. No. 4,937,157, copending application U.S. Ser. No. 07/396,497, and copending application U.S. Ser. No. 07/547,001, the disclosures of each of which are totally incorporated herein by reference, commercially available from Hexcel Fine Chemicals Corporation, Lodi, N.J. The charge control agent typically is present in the second colored toner in an amount of from about 0.05 to about 1.0 percent by weight, and preferably from about 0.05 to about 0.3 percent by weight, although the amount can be outside these ranges.

The second colored toner also has contained on the surface of the toner particles external additives of colloidal silica, such as Aerosil ® R972, Aerosil ® R976, Aerosil ® R812, and the like, available from Degussa, and metal stearate salts, such as zinc stearate, magnesium stearate, aluminum stearate, cadmium stearate, and the like, are blended on the surface of the toners of the present invention. Typically, the silica is present on the surface in an amount of from about 0.1 to about 2 percent by weight of the toner particle, preferably from about 0.1 to about 0.5 percent by weight of the toner particle, and more preferably about 0.3 percent by weight of the toner particle, and the metal stearate salt additive such as zinc stearate typically is present on the surface in an amount of from about 0.1 to about 2 percent by weight of the toner particle, and preferably about 0.3 percent by weight of the toner particle, although the amounts can be outside these ranges.

The first and second colored toners can be blended together in any desired relative amounts to obtain a blend of the desired color. The toner particles are physically mixed together until a uniform mixture of cyan toner particles and blue toner particles has been achieved. Typically, the first blue toner particles are present in the blend in an amount of from about 1.0 to about 99.0 percent by weight, and the second cyan toner particles are present in the blend in an amount of from about 1.0 to about 99.0 percent by weight, although the amounts can be outside these ranges.

Colored developer compositions for the present invention prepared from the blend of toners and the carrier typically comprise from about 0.5 to about 5 percent by weight of the toner blend and from about 95 to about 99.5 percent by weight of the carrier. The ratio of toner to carrier may vary from these ratios, however, provided that the objectives of the present invention are achieved. For example, an imaging apparatus employed for the process of the present invention may be replenished with a colored developer comprising about 55 percent by weight of the toner blend and about 45 percent by weight of the carrier. The triboelectric charge of the colored toners generally is from about −10 to about −30, and preferably from about −15 to about −20 microcoulombs per gram, although the value may be outside of this range provided that the objectives of the present invention are achieved. Particle size of the colored toners is typically from about 7 to about 20 microns in volume average diameter, and preferably about 13 microns in volume average diameter, although the value may be outside this range.

Black developers suitable for the process of the present invention comprise a toner and a carrier. The carrier for the black developer (hereinafter referred to as the "black carrier") generally comprises a steel core, such as Hoeganoes Anchor Steel Grit, with an average diameter of from about 25 to about 215 microns, preferably from about 50 to about 150 microns, with a coating of chlorotrifluoroethylene-vinyl chloride copolymer, commercially available as OXY 461 from Occidental Petroleum Company, said coating containing from 0 to about 40 percent by weight of conductive particles homogeneously dispersed in the coating, at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as Tedlar ® from E. I. Du Pont de Nemours and Company, present in a coating weight of from about 0.01 to about 0.2, and preferably about 0.05, percent by weight of the carrier. The polyvinyl fluoride coating is generally coated onto the core by a powder coating process, wherein the carrier core is coated with the polyvinyl fluoride in powder form and subsequently heated to fuse the coating. In one preferred embodiment, the carrier comprises an unoxidized steel core which is blended with polyvinyl fluoride (Tedlar ®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$ $(\text{ohm-cm})^{-1}$. Optionally, an additional coating of polyvinylidene fluoride, commercially available as Kynar ® from Pennwalt Corporation, may be powder coated on top of the other coating of the carrier in the black developer at a coating weight of from about 0.01 to about 0.2 percent by weight. The carrier for the black developer generally has a conductivity of from about $10^{-14}$ to about $10^{-7}$ (ohm-cm)$^{-1}$, and preferably from about $10^{-12}$ to about $10^{-9}$ (ohm-cm)$^{-1}$.

Black toners suitable for development of the image generally comprise a resin, a black pigment, and a charge control additive. Suitable resins include polyesters, styrene-butadiene polymers, styrene acrylate polymers, and styrene-methacrylate polymers, and particularly styrene-n-butylmethacrylate copolymers wherein the styrene portion is present in an amount of from about 50 to about 80 percent by weight, preferably about 58 percent by weight, and the n-butylmethacrylate portion is present in an amount of from about 20 to about 50 percent by weight, preferably about 42 percent by weight. Typically, the resin is present in an amount of from about 80 to about 98.8 percent by weight, and preferably in an amount of 92 percent by weight, although the amount can be outside these ranges. Suitable pigments include those such as carbon black, including as Regal® 330, commercially available from Cabot Corporation. Typically, the pigment is present in an amount of from about 1 to about 15 percent by weight, and preferably in an amount of about 6 percent by weight, although the amount can be outside these ranges.

Suitable charge control agents for the black toner of the present invention include distearyl dimethyl ammonium methyl sulfate and alkyl pyridinium halides such as cetyl pyridinium chloride and the like. The charge control agent typically is present in an amount of from about 0.1 to about 6 percent by weight, and preferably in an amount of about 2 percent by weight, although the amount can be outside these ranges. In addition, the black toner may contain magnetite, such as Mapico Black, in an amount of from about 8 to about 20, and preferably about 15 or 16 percent by weight. A toner suitable for the present invention containing magnetite typically comprises from about 71.25 to about 87.8 percent by weight of the resin, from about 8 to about 20 percent by weight of the magnetite, from about 4 to about 7 percent by weight of carbon black, and from about 0.2 to about 1.75 percent by weight of the charge control additive, although the amounts can be outside these ranges.

In addition, external additives of colloidal silica, such as Aerosil® R972, Aerosil® R976, Aerosil® R812, and the like, available from Degussa, and metal salts or metal salts of fatty acids, such as zinc stearate, magnesium stearate, and the like, may optionally be blended on the surface of the black toner. Typically, the silica is present in an amount of from about 0.1 to about 2 percent by weight of the toner and the metal stearate is present in an amount of from about 0.1 to about 2 percent by weight of the toner, although the amounts can be outside these ranges. These additives function in the manner described for the color toners with respect to charge control, admix control, conductivity control, and the like.

The black toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50. Linear polymeric alcohols of this type are generally available from Petrolite Chemical Company as Unilin TM. The linear polymeric alcohol is typically present in an amount of from about 0.1 to about 1 percent by weight of the toner, although the amount can be outside this range.

Black developer compositions for the present invention typically comprise from about 1 to about 5 percent by weight of the toner and from about 95 to about 99 percent by weight of the carrier. The ratio of toner to carrier may vary, however, provided that the objectives of the present invention are achieved. For example, an imaging apparatus employed for the process of the present invention may be replenished with a colored developer comprising about 65 percent by weight toner and about 35 percent by weight carrier. The triboelectric charge of the black toners generally is from about +10 to about +30, and preferably from about +13 to about +18 microcoulombs per gram, although the value may be outside of this range provided that the objectives of the present invention are achieved. Particle size of the black toners is generally from about 8 to about 13 microns in volume average diameter, and preferably about 11 microns in volume average diameter, although the value may be outside of this range.

Coating of the carrier particles of the present invention may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved.

The toners of the present invention may be prepared by processes such as extrusion, which is a continuous process that entails dry blending the resin, pigment, and charge control additive, placing them into an extruder, melting and mixing the mixture, extruding the material, and reducing the extruded material to pellet form. The pellets are further reduced in size by grinding or jetting, and are then classified by particle size. External additives such as linear polymeric alcohols, silica, or zinc stearate are then blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A black developer composition was prepared containing a toner comprising 2 percent by weight of cetyl pyridinium chloride (obtained from Hexcel Corporation), 6 percent by weight Regal® 330 carbon black (obtained from Cabot Corporation), and 92 percent by weight of a styrene/n-butylmethacrylate polymer containing 58 percent by weight styrene and 42 percent by weight n-butylmethacrylate. The black toner particles had a particle size of 11.4 microns in volume average diameter. The black carrier comprised a Hoeganoes steel grit core coated with a polyvinyl fluoride (Tedlar ®, obtained from E. I. Du Pont de Nemours & Company) coating in a coating weight such that the carrier comprised 0.05 percent by weight of the coating and 99.95 percent by weight of the core. The black toner and black carrier were mixed together in relative amounts of 3 parts by weight of toner to 100 parts by weight of carrier, resulting in a developer with a toner exhibiting a triboelectric charge of +18.6 microcoulombs per gram and a developer conductivity of $6.6\times10^{-10}$ (ohm·cm)$^{-}$. Admix time for the black toner with the carrier was less than 30 seconds.

EXAMPLE II

A blue toner composition was prepared containing 90.5 percent by weight Pliotone ® resin (obtained from Goodyear), 7.0 percent by weight PV Fast Blue B2G-A pigment (obtained from Hoechst-Celanese), 2.0 percent by weight Bontron E-88 aluminum compound charge control agent (obtained from Orient Chemical, Japan), and 0.5 percent by weight cetyl pyridinium chloride charge control agent (obtained from Hexcel Corporation). The toner components were first dry blended and then melt mixed in an extruder. The extruder strands were cooled, chopped into small pellets, ground into toner particles, and then classified to narrow the particle size distribution. The toner particles had a particle size of 12.5 microns in volume average diameter. Subsequently, the toner particles were dry blended with silica particles (Aerosil ® R972, obtained from Degussa) in an amount of 0.3 percent by weight of the toner particles, and zinc stearate (obtained from Synthetic Products) in an amount of 0.3 percent by weight of the toner particles.

A carrier composition for use with the color toners (hereinafter referred to as "color carrier") was prepared by coating Hoeganoes Steel Grit cores (obtained from Hoeganoes) with a coating comprising 80 percent by weight polymethyl methacrylate (obtained from E. I. Du Pont de Nemours & Company) and 20 percent by weight Vulcan carbon black (obtained from Cabot Corp.), wherein the core was present in an amount of 99.2 percent by weight and the coating was present in an amount of 0.8 percent by weight. Coating was carried out by a solution coating process from methyl ethyl ketone.

A color developer composition was prepared by mixing together 3 parts by weight of the blue toner with 100 parts by weight of the color carrier particles, resulting in a developer with a toner exhibiting a triboelectric charge of −16.4 microcoulombs per gram and a developer conductivity of $2.0\times10^{-11}$ (ohm·cm)$^{-1}$. Admix time for the blue toner with the color carrier was 30 seconds or less.

The color developer thus prepared, along with the black developer described in Example I, was incorporated into a printer test fixture comprising a flexible, seamless organic imaging member and two developer housings, wherein a two-color image can be developed in a single pass by having the imaging member bearing a tri-level latent image pass both developer housings sequentially. In the test fixture, a tri-level latent image was generated on the imaging member. The color image was developed first with the blue developer, followed by development of the black image with the black developer. The two-color image thus formed was then transferred to paper and heat fused to the paper. 50,000 prints were run in the tri-level imaging fixture while maintaining the blue and black toner concentrations nearly constant at 3 parts by weight of toner to 100 parts by weight of the respective carrier. The two-color prints exhibited excellent copy quality with very low background over the course of the print test. Triboelectric charging of the toners and developer conductivities were stable. There were no deleterious interactions between the developed blue image and the black developer as the developed blue image passed through the active second development zone. Likewise, there were no deleterious or nonuniform interactions between the highly charged latent photoreceptor image intended to be developed with black toner and the color developer as the highly charged latent image passed through the active first development zone. Furthermore, toner additives were not observed to separate from the toner in any manner that degraded copy quality or eroded the electrical properties of the developer.

Following the 50,000 print test at the nominal toner concentration, an additional 10,000 print test was carried out in which the blue toner concentration was rapidly and systematically varied between approximately 1.5 parts by weight of toner to 100 parts by weight of color carrier and 7 parts by weight of toner to 100 parts by weight of color carrier. Print quality, admix time, and toner triboelectric charging remained excellent over an acceptable range of excursion in toner concentration. Furthermore, developer electrical properties returned to their nominal values when the color toner concentration was returned to the initial value of 3 parts by weight of toner to 100 parts by weight of carrier.

EXAMPLE III

A cyan toner composition was prepared containing 94.9 percent by weight Pliotone ® resin (obtained from Goodyear), 5.0 percent by weight Neopen Blue pigment (obtained from BASF), and 0.1 percent by weight distearyl dimethyl ammonium methyl sulfate charge control agent (obtained from Hexcel Corporation). The toner components were first dry blended and then melt mixed in an extruder. The extruder strands were cooled, chopped into small pellets, ground into toner particles, and then classified to narrow the particle size distribution. The toner particles had a particle size of 12.5 microns in volume average diameter. Subsequently, the toner particles were dry blended with silica particles (Aerosil ® R972, obtained from Degussa) in an amount of 0.3 percent by weight of the toner particles, and zinc stearate (obtained from Synthetic Products) in an amount of 0.3 percent by weight of the toner particles.

A cyan developer composition was prepared by mixing together 3 parts by weight of the cyan toner with 100 parts by weight of the color carrier particles, prepared as described in Example I, resulting in a developer with a toner exhibiting a triboelectric charge of −18.8 microcoulombs per gram and a developer conductivity of $3.3\times10^{-11}$ (ohm·cm)$^{-1}$. Admix time for the cyan toner with the color carrier was 30 seconds or less.

The cyan developer thus prepared, along with the black developer described in Example I, was incorporated into the tri-level printer test fixture described in Example II. The color image was developed first with the cyan developer, followed by development of the black image with the black developer. The two-color image thus formed was then transferred to paper and heat fused to the paper. 50,000 prints were run in the tri-level imaging fixture while maintaining the cyan and black toner concentrations nearly constant at 3 parts by weight of toner to 100 parts by weight of the respective carrier. The two-color prints exhibited excellent copy quality with very low background over the course of the print test. Triboelectric charging of the toners and developer conductivities were stable. There were no deleterious interactions between the developed cyan image and the black developer as the developed cyan image passed through the active second development zone. Likewise, there were no deleterious or nonuniform interactions between the highly charged latent photoreceptor image intended to be developed with black toner and the color developer as the highly charged latent image passed through the active first development zone. Furthermore, toner additives were not observed to separate from the toner in any manner that degraded copy quality or eroded the electrical properties of the developer.

Following the 50,000 print test at the nominal toner concentration, an additional 9,000 print test was carried out in which the cyan toner concentration was rapidly and systematically varied between approximately 1.5 parts by weight of toner to 100 parts by weight of color carrier and 7 parts by weight of toner to 100 parts by weight of color carrier. Print quality, admix time, and toner triboelectric charging remained excellent over an acceptable range of excursion in toner concentration. Furthermore, developer electrical properties returned to their nominal values when the cyan toner concentration was returned to the initial value of 3 parts by weight of toner to 100 parts by weight of carrier.

EXAMPLE IV

The blue toner prepared as described in Example II and a cyan toner prepared as described in Example III except that the cyan toner contained 0.2 percent by weight distearyl dimethyl ammonium methyl sulfate were blended together in a 1:1 ratio. The resulting blue/cyan toner blend was mixed with the color carrier described in Example II in a relative concentration of 3 parts by weight of the toner blend and 100 parts by weight of the carrier particles. The resulting color developer exhibited a toner triboelectric charge of −20.1 microcoulombs per gram and a developer conductivity of $2.3\times10^{-11}$ (ohm·cm)$^{-1}$. Admix time for the blue/cyan toner blend with the color carrier was 30 seconds or less.

The blue/cyan developer was incorporated into the printing test fixture described in Example II along with the black developer described in Example I, and 50,000 prints were generated while maintaining the blue/cyan and black toner concentrations nearly constant at 3 parts by weight of toner to 100 parts by weight of the respective carrier. The two-color prints thus obtained, consisting of the 1:1 blue/cyan toner blend as the first color and the black toner as the second color, exhibited excellent copy quality with very low background over the course of the print test. Triboelectric charging of the toners and developer conductivities were stable. There were no deleterious interactions between the developed color image and the black developer as the developed blue/cyan image passed through the active second development zone. Likewise, there were no deleterious or nonuniform interactions between the highly charged latent photoreceptor image intended to be developed with black toner and the color developer as the highly charged latent image passed through the active first development zone. Furthermore, toner additives were not observed to separate from the toners in any manner that degraded copy quality or eroded the electrical properties of the developer.

Following the 50,000 print test at the nominal toner concentration, an additional 13,000 print test was carried out in which the blue/cyan toner concentration in the color developer was rapidly and systematically varied between approximately 1.5 parts by weight of toner to 100 parts by weight of color carrier and 7 parts by weight of toner to 100 parts by weight of carrier. Print quality, admix time, and toner triboelectric charging remained excellent over an acceptable range of excursion in toner concentration. Furthermore, developer electrical properties returned to their nominal values when the color toner blend concentration was returned to the initial value of 3 parts by weight of toner to 100 parts by weight of carrier.

Detailed examination of the prints over the full course of the test verified that the blue and cyan toners did not separate in the color developer such that one was preferentially developed over the other. Results were fully consistent with a uniform and simultaneous development of the blue and cyan toners in the intended 1:1 ratio over the course of the test.

EXAMPLE V

The blue toner prepared as described in Example II and the cyan toner prepared as described in Example III were blended together in a 1:3 ratio. The resulting blue/cyan blend was mixed with the color carrier described in Example II in relative concentrations of 3 parts by weight of the toner blend and 100 parts by weight of the carrier particles. The resulting color developer exhibited a toner triboelectric charge of −19.0 microcoulombs per gram and a developer conductivity of $6.0\times10^{-10}$ (ohm·cm)$^{-1}$. Admix time for the blue/cyan toner blend with the color carrier was 30 seconds or less.

The blue/cyan developer was incorporated into the printing test fixture described in Example II and 10,300 color prints were generated. Color prints were generated by appropriate charging and exposure of the imaging member such that only the latent color image and the background reference voltages were produced. The black developer housing was disabled by test fixture process controls. Compatibility of the blue and cyan developers with the black developer for tri-level highlight color application was separately established as described in Examples II and III. Likewise, compatibility of the blue/cyan toner blend with the black developer was demonstrated as described in Example IV.

The 10,300 color print test was essentially carried out with a blue/cyan toner blend concentration of 3 parts by weight of toner to 100 parts by weight of color carrier, but encompassed two significant spans where the toner concentration was systematically varied between approximately 1.5 parts by weight of toner to 100 parts by weight of carrier and approximately 7 parts by weight of toner to 100 parts by weight of carrier. Print quality, admix time, and toner triboelectric charging remained excellent over an acceptable range of excursion in toner concentration. Furthermore, developer electrical properties returned to their nominal values when the color toner blend concentration was returned to the initial value of 3 parts by weight of toner to 100 parts by weight of carrier. Toner additives were not observed to separate from the toners in any manner that degraded copy quality or eroded the electrical properties of the developer.

Detailed examination of the prints over the full course of the test verified that the blue and cyan toners did not separate in the color developer such that one was preferentially developed over the other. Results were fully consistent with a uniform and simultaneous development of the blue and cyan toners in the intended 1:3 ratio over the course of the test.

COMPARATIVE EXAMPLE A

A red toner composition was prepared as follows. 91.72 parts by weight Pliotone® resin (obtained from Goodyear), 1 part by weight distearyl dimethyl ammonium methyl sulfate (obtained from Hexcel Corporation), 6.72 parts by weight Lithol Scarlet NB3755 pigment (obtained from BASF), and 0.56 parts by weight Magenta Predisperse (Hostaperm Pink E pigment dispersed in a polymer resin, obtained from Hoechst-Celanese) were melt blended in an extruder wherein the die was maintained at a temperature of between 130° and 145° C. and the barrel temperature ranged from about 80° to about 100° C., followed by micronization and air classification to yield toner particles of a size of 12.5 microns in volume average diameter. The toner particles (100 parts by weight) were then dry blended with 0.3 parts by weight of Aerosil® R972 and 0.3 parts by weight of zinc stearate onto the surface of the toner in a Lodige blender.

A color developer composition was prepared by mixing together 3 parts by weight of the red toner with 100 parts by weight of the color carrier particles, prepared as described in Example II. This formulation resulted in a developer with a toner exhibiting a triboelectric charge of −16.0 microcoulombs per gram and a developer conductivity of $2.2\times10^{-10}$ (ohm·cm)$^{-1}$. Admix time for the red toner with the color carrier was 30 seconds or less.

The color developer thus prepared, along with the black developer described in Example I, was incorporated into the printer test fixture described in Example II. 50,000 prints were generated while maintaining the red and black toner concentrations nearly constant at 3 parts by weight of toner to 100 parts by weight of the respective carrier. The two-color prints exhibited excellent copy quality with very low background over the course of the print test. Triboelectric charging of the toners and developer conductivities were stable. There were no deleterious interactions between the developed red image and the black developer as the developed red image passed through the active second development zone. Likewise, there were no deleterious or nonuniform interactions between the highly charged latent photoreceptor image intended to develop black toner and the color developer as the highly charged latent image passed through the active first development zone. Furthermore, toner additives were not observed to separate from the toner in any manner that degraded copy quality or eroded the electrical properties of the developer.

Following the 50,000 print test at the nominal toner concentration, an additional 10,000 print test was carried out in which the red toner concentration was rapidly and systematically varied between approximately 1.5 parts by weight of toner to 100 parts by weight of color carrier and 7 parts by weight of toner to 100 parts by weight of carrier. Print quality, admix time, and toner triboelectric charging remained excellent over an acceptable range of excursion in toner concentration. Furthermore, developer electrical properties returned to their nominal values when the color toner concentration was returned to the initial value of 3 parts by weight of toner to 100 parts by weight of carrier.

COMPARATIVE EXAMPLE B

One part by weight of the red toner particles prepared as described in Comparative Example A was admixed with one part by weight of the blue toner particles prepared as described in Example II. The resulting red/blue toner blend was mixed with the color carrier described in Example II in relative concentrations of 3 parts by weight of the toner blend and 100 parts by weight of the carrier particles to give a developer exhibiting a toner triboelectric charge of −18.5 microcoulombs per gram and a developer conductivity of $8.2\times10^{-11}$ (ohm·cm)$^{-1}$. The resulting red/blue developer was incorporated into the printing test fixture described in Example II and 5,770 color prints were generated by appropriate charging and exposure of the imaging member such that only the latent color image and the background reference voltages were produced. The black developer housing was disabled by test fixture process controls. Compatibility of the red and blue developers with the black developer for tri-level highlight color application was separately established in Comparative Example A and Example II, respectively. The test results were as follows:

The red/blue blend exhibited unacceptable and selective toner separation from the developer, beginning at the onset of the test. The red toner failed to charge properly against the blue toner/color carrier mix, resulting in severe scatter of red toner inside the test fixture and a readily detectable color shift in the fused prints as the red toner was selectively purged from the developer mixture.

The test was terminated at 5,770 prints because of the failure of two toners comprising the blend to develop simultaneously and collectively to produce constant color prints with low levels of background. The results of this Comparative Example demonstrate that color toners which are separately functional in tri-level applications do not necessarily form functional blends when mixed together in a single developer formulation.

COMPARATIVE EXAMPLE C

A magenta toner composition was prepared as follows. 92.5 percent by weight Pliotone® resin (obtained from Goodyear), 5.0 percent by weight Hostaperm Pink E pigment (obtained from Hoechst-Celanese), 2.0 percent by weight Bontron E-88 aluminum compound charge control agent (obtained from Orient Chemical, Japan), and 0.5 percent by weight cetyl pyridinium chloride charge control agent (obtained from Hexcel Corporation) were melt blended in an extruder wherein the die was maintained at a temperature of between 130° and 145° C. and the barrel temperature ranged from about 80° to about 100° C., followed by micronization and air classification to yield toner particles of a size of 12.5 microns in volume average diameter. The toner particles were then dry blended with 0.3 parts by weight of Aerosil® R972 and 0.3 parts by weight of zinc stearate onto the surface of the toner in a Lodige blender.

A color developer composition was prepared by mixing together 3 parts by weight of the magenta toner with 100 parts by weight of the color carrier particles prepared as described in Example II. This formulation resulted in a developer with a toner exhibiting a triboelectric charge of −14.5 microcoulombs per gram and a developer conductivity of $9.0\times10^{-10}$ (ohm·cm)$^{-1}$.

The color developer thus prepared, along with the black developer described in Example I, was incorporated into the printer test fixture described in Example II. 1,500 prints were generated while maintaining the magenta and black toner concentrations nearly constant at 3 parts by weight of toner to 100 parts by weight of the respective carrier. The two-color prints exhibited excellent copy quality with very low background over the course of the print test. Triboelectric charging of the toners and developer conductivities were stable. There were no deleterious interactions between the developed magenta image and the black developer as the developed magenta image passed through the active second development zone. Likewise, there were no deleterious or nonuniform interactions between the highly charged latent photoreceptor image intended to be developed with black toner and the color developer as the highly charged latent image passed through the active first development zone.

Following the 1,500 two-color print test, 14,400 single color prints were generated by disabling black development as described in Comparative Example B. The 14,400 color print test was essentially carried out with a magenta toner concentration of 3 parts by weight of toner to 100 parts by weight of color carrier, but encompassed two significant spans where the toner concentration was systematically varied between approximately 1.5 parts by weight of toner to 100 parts by weight of carrier and approximately 7 parts by weight of toner to 100 parts by weight of carrier. Print quality, admix time, and toner triboelectric charging remained excellent over an acceptable range of excursion in toner concentration. Furthermore, developer electrical properties returned to their nominal values when the magenta toner concentration was returned to the initial value of 3 parts by weight of toner to 100 parts by weight of carrier. Toner additives were not observed to separate from the magenta toner in any manner that degraded copy quality or eroded the electrical properties of the developer.

COMPARATIVE EXAMPLE D

One part by weight of the magenta toner particles prepared as described in Comparative Example C was mixed with four parts by weight of the red toner particles prepared as described in Comparative Example A. The resulting magenta/red toner blend was mixed with the color carrier described in Example II in relative concentrations of 3 parts by weight of the toner blend and 100 parts by weight of the carrier particles to give a developer exhibiting a toner triboelectric charge of −18.0 microcoulombs per gram and a developer conductivity of $7.0\times10^{-10}$ (ohm·cm)$^{-1}$. The resulting magenta/red developer was incorporated into the printing test fixture described in Example II, and 14,400 color prints were generated as described in Comparative Example B.

The 14,400 color print test was essentially carried out with a magenta/red toner blend concentration of 3 parts by weight of toner to 100 parts by weight of color carrier, but encompassed two significant spans where the toner concentration was systematically varied between approximately 1.5 parts by weight of toner to 100 parts by weight of carrier and approximately 7 parts by weight of toner to 100 parts by weight of carrier. Print quality, admix time, and toner triboelectric charging were excellent when the toner concentration was held at nominal. Print quality was unacceptable when the toner concentration was raised above nominal, due to the simultaneous development of the color toners in the image background.

The results of this Comparative Example further demonstrate that color toners which are separately functional in tri-level applications do not necessarily form functional blends when mixed together in a single developer formulation.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for forming two-color images which comprises (1) charging an imaging member in an imaging apparatus; (2) creating on the member a latent image comprising areas of high, intermediate, and low potential; (3) developing the low areas of potential with a colored developer comprising a colored first toner comprising a polymer resin selected from the group consisting of polyester, styrene-butadiene copolymers, styrene-acrylate copolymers, styrene-methacrylate copolymers, and mixtures thereof, a blue first colored pigment of the formula $C_{32}H_{16}N_8Cu$, a cetyl pyridinium chloride charge control agent, a 3,5-di-tert-butyl salicylate compound charge control agent, colloidal silica surface external additives, and metal stearate salt surface external additives; a colored second toner comprising a polymer resin selected from the group consisting of styrene-butadiene copolymers, styrene-acrylate copolymers, styrene-methacrylate copolymers, and mixtures thereof, a cyan second colored pigment of the formula $C_{104}H_{164}N_{12}O_8S_4Cu$, a charge control agent selected from the group consisting of distearyl dimethyl ammonium methyl sulfate and distearyl dimethyl ammonium bisulfate, colloidal silica surface external additives, and metal stearate salt surface external additives; and a color carrier comprising a core and a coating selected from the group consisting of methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles; (4) subsequently developing the high areas of potential with a black developer comprising a black toner comprising a second resin present selected from the group consisting of polyesters, styrene-butadiene polymers, styrene-acrylate polymers, styrene-methacrylate polymers, and mixtures thereof, a black pigment, and a charge control additive; and a black carrier comprising a core and a coating selected from the group consisting of chlorotrifluoroethylene-vinyl chloride copolymer containing from 0 to about 40 percent by weight of conductive particles; polyvinylfluoride; and polyvinylchloride; and (5) transferring the developed two-color image to a substrate.

2. A process according to claim 1 wherein the colored first toner contains the polymer resin in an amount of from about 85 to about 98 percent by weight, the blue pigment in an amount of from about 1 to about 10 percent by weight, the cetyl pyridinium chloride charge control agent in an amount of from about 0.1 to about 1.0 percent by weight, and the 3,5-di-tert-butyl salicylate compound charge control agent in an amount of from about 0.1 to about 5 percent by weight, and wherein the colloidal silica surface additive is present in an amount of from about 0.1 to about 2 percent by weight of the toner particles and the metal stearate salt surface additive is present in an amount of from about 0.1 to about 2 percent by weight of the toner particles.

3. A process according to claim 1 wherein the colored second toner contains the polymer resin in an amount of from about 85 to about 98 percent by weight, the cyan pigment in an amount of from about 1 to about 10 percent by weight, and the charge control agent in an amount of from about 0.05 to about 1.0 percent by weight, and wherein the colloidal silica surface additive is present in an amount of from about 0.1 to about 2 percent by weight of the toner particles and the metal stearate salt surface additive is present in an amount of from about 0.1 to about 2 percent by weight of the toner particles.

4. A process according to claim 1 wherein the colored first toner contains the polymer resin in an amount of from about 90 to about 95 percent by weight, the blue pigment in an amount of from about 4 to about 8 percent by weight, the cetyl pyridinium chloride charge control agent in an amount of from about 0,3 to about 0,6 percent by weight, and the 3,5-di-tert-butyl salicylate compound charge control agent in an amount of from about 0.5 to about 3 percent by weight, and wherein the colloidal silica surface additive is present in an amount of from about 0.1 to about 0.5 percent by weight of the toner particles and the metal stearate salt surface additive is present in an amount of from about 0.1 to about 0.5 percent by weight of the toner particles and wherein the colored second toner contains the styrene-butadiene resin in an amount of from about 90 to about 95 percent by weight, the cyan pigment in an amount of from about 4 to about 8 percent by weight, and the charge control agent in an amount of from about 0.05 to about 0.3 percent by weight, and wherein the colloidal silica surface additive is present in an amount of from about 0.1 to about 0.5 percent by weight of the toner particles and the metal stearate salt surface additive is present in an amount of from about 0.1 to about 0.5 percent by weight of the toner particles.

5. A process according to claim 1 wherein the colored first toner and the colored second toner are present in relative amounts of from about 1 to about 99 percent by weight of the colored second toner and from about 1 to about 99 percent by weight of the colored first toner.

6. A process according to claim 1 wherein the colored first toner contains a styrene-n-butylmethacrylate copolymer resin.

7. A process according to claim 1 wherein the colored second toner contains a styrene-n-butylmethacrylate copolymer resin.

8. A process according to claim 1 wherein the colored first toner and the colored second toner each contain a styrene-n-butylmethacrylate copolymer resin.

9. A process according to claim 1 wherein the colored first toner contains a styrene-butadiene copolymer resin in which the styrene portion is present in an amount of from about 83 to about 93 percent by weight and the butadiene portion is present in an amount of from about 7 to about 17 percent by weight.

10. A process according to claim 1 wherein the colored second toner contains a styrene-butadiene copolymer resin in which the styrene portion is present in an amount of from about 83 to about 93 percent by weight and the butadiene portion is present in an amount of from about 7 to about 17 percent by weight.

11. A process according to claim 1 wherein the colored first toner and the colored second toner each contain a styrene-butadiene copolymer resin in which the styrene portion is present in an amount of from about 83 to about 93 percent by weight and the butadiene portion is present in an amount of from about 7 to about 17 percent by weight.

12. A process according to claim 1 wherein the 3,5-di-tert-butyl salicylate compound charge control agent in the colored first toner is an aluminum 3,5-di-tert-butyl salicylate compound.

13. A process according to claim 1 wherein the 3,5-di-tert-butyl salicylate compound charge control agent in the colored first toner is a zinc 3,5-di-tert-butyl salicylate compound.

14. A process according to claim 1 wherein the 3,5-di-tert-butyl salicylate compound charge control agent in the colored first toner is a boron 3,5-di-tert-butyl salicylate compound.

15. A process according to claim 1 wherein the charge control agent in the colored second toner is distearyl dimethyl ammonium methyl sulfate.

16. A process according to claim 1 wherein the charge control agent in the colored second toner is distearyl dimethyl ammonium bisulfate.

17. A process according to claim 1 wherein the color carrier comprises an unoxidized steel core with a coating comprising about 80 percent by weight polymethyl methacrylate and about 20 percent by weight carbon black, at a coating weight of about 0.8 percent by weight of the core.

18. A process according to claim 1 wherein the black toner contains a styrene/n-butylmethacrylate copolymer resin in an amount of about 92 percent by weight, a carbon black pigment in an amount of about 6 percent by weight, and a cetyl pyridinium chloride charge control agent in an amount of about 2 percent by weight.

19. A process according to claim 1 wherein the black carrier comprises an unoxidized steel core with a coating of polyvinyl fluoride at a coating weight of about 0.05 percent by weight of the core.

20. A process according to claim 1 wherein the colored first toner particles and the colored second toner particles each have a volume average diameter of from about 7 to about 20 microns.

21. A process according to claim 1 wherein the blue first colored pigment has the structural formula

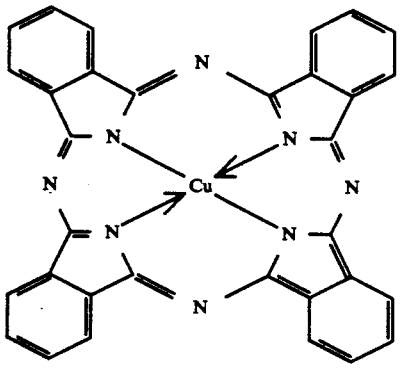
and wherein the cyan second colored pigment has the structural formula
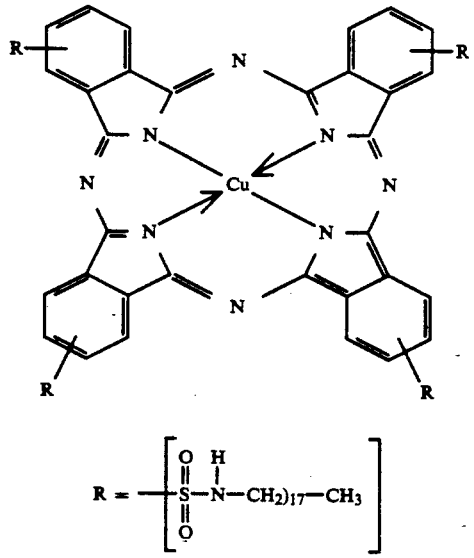
* * * * *